US008968045B2

(12) United States Patent
Saito

(10) Patent No.: US 8,968,045 B2
(45) Date of Patent: Mar. 3, 2015

(54) CATHODE SELECTION METHOD

(71) Applicant: NuFlare Technology, Inc., Yokohama (JP)

(72) Inventor: Kenichi Saito, Kanagawa (JP)

(73) Assignee: NuFlare Technology, Inc., Yokohama (JP)

( * ) Notice: Subject to any disclaimer, the term of this patent is extended or adjusted under 35 U.S.C. 154(b) by 0 days.

(21) Appl. No.: 14/064,520

(22) Filed: Oct. 28, 2013

(65) Prior Publication Data

US 2014/0117839 A1 May 1, 2014

(30) Foreign Application Priority Data

Oct. 30, 2012 (JP) ..... 2012-239012

(51) Int. Cl.
*H01J 9/42* (2006.01)
*H01J 1/13* (2006.01)

(52) U.S. Cl.
CPC ..... *H01J 1/13* (2013.01)
USPC ..... 445/63; 445/3; 445/49; 445/51; 313/421

(58) Field of Classification Search
CPC ..... H01J 9/042; H01J 9/42; H01J 9/025; H01J 1/304; H01J 2329/00; H01J 37/08; H01J 2237/082; H01J 29/485; H01J 31/60; H01J 29/04; H01J 29/46; H01J 29/48; H01J 29/50; H01J 29/503; H01J 2237/245; H01J 2237/24564; H01J 2237/24571; H01J 2237/24585; H01J 2237/24592; H01J 2237/0432; H01J 2237/0633; H01J 2237/06341; H01J 2237/206; H01J 2237/2065; H01J 2237/2482; H01J 2237/2803; H01J 2237/2809; H01J 2237/2813; H01J 2237/2855; H01J 37/065; H01J 37/073; H01J 37/24; H01J 37/243; H01J 37/26; H01J 37/265
USPC ..... 445/3, 49, 51, 63; 313/421–440, 313/309–311, 453, 336, 346
See application file for complete search history.

(56) References Cited

U.S. PATENT DOCUMENTS

| | | | | |
|---|---|---|---|---|
| 7,176,610 | B2 | 2/2007 | Katsap | |
| 7,508,216 | B2 * | 3/2009 | Wei et al. | 324/467 |
| 2002/0020822 | A1 * | 2/2002 | Okunuki | 250/492.3 |
| 2005/0174030 | A1 * | 8/2005 | Katsap | 313/346 R |
| 2008/0012587 | A1 * | 1/2008 | Wei et al. | 324/719 |
| 2011/0243184 | A1 * | 10/2011 | Nakabayashi et al. | 374/142 |
| 2012/0153805 | A1 | 6/2012 | Watanabe et al. | |

FOREIGN PATENT DOCUMENTS

| | | |
|---|---|---|
| JP | 2005-228741 | 8/2005 |
| JP | 2010-161061 | 7/2010 |
| WO | WO 2011/024821 A1 | 3/2011 |

* cited by examiner

*Primary Examiner* — Anne Hines
*Assistant Examiner* — Jose M Diaz
(74) *Attorney, Agent, or Firm* — Oblon, McClelland, Maier & Neustadt, L.L.P.

(57) ABSTRACT

A cathode selection method includes measuring, by using a cathode having an electron emission surface which is a flat surface and a emission area which is limited, a total emission emitted from the cathode; calculating, using a measured total emission value, work function by a Richardson Dash Man's formula; and determining whether or not the cathode has the work function equal to or under an acceptable value.

14 Claims, 14 Drawing Sheets

CATHODE SELECTION METHOD

CROSS-REFERENCE TO RELATED APPLICATION

This application is based upon and claims the benefit of priority from prior Japanese Patent Application No. 2012-239012 filed on Oct. 30, 2012 in Japan, the entire contents of which are incorporated herein by reference.

BACKGROUND OF THE INVENTION

1. Field of the Invention

Embodiments described herein relate generally to a cathode selection method, and for example, relate to a selection method of a cathode of a beam source used in a charged particle beam lithography apparatus.

2. Related Art

In an electron beam apparatus, an electron gun assembly, which serves as a beam source, is used. There are various devices among the electron beam apparatuses such as an electron beam lithography apparatus and an electron microscope. With respect to electron beam writing, for example, it essentially has an excellent resolution and is used in a production of a precise original pattern.

A lithography technique, which takes a part of the development of miniaturization of semiconductor devices, is an only process in semiconductor manufacturing processes in which a pattern is generated and is very important. In recent years, with advancement in integration density of an LSI, a circuit line width required for a semiconductor device is miniaturized year by year. In order to form a desired circuit pattern on such a semiconductor device, a precise original pattern (also referred to as a reticle or a mask) is required. An electron beam (EB) lithography apparatus is used in the production of such a precise original pattern.

FIG. 18 is a conceptual diagram illustrating an operation of a variable-shaped electron beam lithography apparatus. The variable-shaped electron beam lithography apparatus operates as below. A rectangular opening 411 to shape an electron beam 330 is formed in a first aperture plate 410. A variable-shaped opening 421 to shape the electron beam 330 having passed through the opening 411 of the first aperture plate 410 into a desired rectangular shape is formed in a second aperture plate 420. The electron beam 330 radiated from a charged particle source 430 and having passed through the opening 411 of the first aperture plate 410 is deflected by a deflector, passes through a part of the variable-shaped opening 421 of the second aperture plate 420, and irradiates a target object 340 placed on a stage continuously moving in one predetermined direction (for example, an X direction). In other words, an rectangular shape that can pass through both the opening 411 of the first aperture plate 410 and the variable-shaped opening 421 of the second aperture plate 420 is written on a write region of the target object 340 placed on the stage continuously moving in the X direction. A method in which an arbitrary shape is formed by allowing an electron beam 330 to pass through both the opening 411 of the first aperture plate 410 and the variable-shaped opening 421 of the second aperture plate 420 is called the variable-shaped beam method (VSB method).

In the electron beam writing, along with the miniaturization of integrated circuit, a shot size is decreasing while the number of shots is increasing. As a result, a writing time also becomes longer. Therefore, a reduction of the writing time, or in other words, an improvement of a throughput of the lithography apparatus is desired. In order to improve the throughput of the lithography apparatus, it is necessary to increase a current density of an electron beam. In order to increase the current density, it is necessary to make brightness higher for a cathode of an electron gun assembly, which serves as a beam source. For example, a lanthanum hexaboride ($LaB_6$) crystal is used as the cathode (as disclosed for example in JP-A-2005-228741). In order to increase brightness of a thermionic emission cathode, there is a method of increasing a temperature of the cathode. However, if the temperature of the cathode is increased, a cathode life becomes shorter as an evaporation rate of a cathode material becomes larger. For example, in a cathode using the lanthanum hexaboride ($LaB_6$) crystal as the material, it is difficult to raise the temperature of the cathode, for example, significantly higher than 1800 Kelvin (K). Therefore, there is a limit in achieving the high brightness by increasing the temperature of the cathode to be used.

On the other hand, in a $LaB_6$ crystal, for example, manufactured by a zone melting method and the like, a composition ratio of lanthanum (La) and boron (B), an impurity density, and the like are different depending on a position within the crystal. Therefore, even in a case where a plurality of cathodes is manufactured from the same mass of crystal, the brightness obtained may vary for each completed cathode. Accordingly, even in the case where the plurality of cathodes is manufactured, there is a problem in that there are many cathodes with which the desired value of brightness cannot be obtained when used in electron beam apparatuses.

BRIEF SUMMARY OF THE INVENTION

In accordance with one aspect of the present invention, a cathode selection method includes:

measuring, by using a cathode having an electron emission surface which is a flat surface and a emission area which is limited, a total emission emitted from the cathode;

calculating, using a measured total emission value, work function by a Richardson Dash Man's formula; and determining whether or not the cathode has the work function equal to or under an acceptable value.

In accordance with another aspect of the present invention, an electron beam lithography apparatus includes:

an electron gun assembly incorporating a cathode selected by the cathode selection method; and a deflector configured to deflect an electron beam emitted from the electron gun assembly.

In accordance with further another aspect of the present invention, an electron beam writing method includes:

emitting an electron beam from an electron gun assembly incorporating a cathode selected by the cathode selection method; and deflecting the electron beam emitted from the electron gun assembly onto a target object.

DETAILED DESCRIPTION OF THE INVENTION

Figure 1:
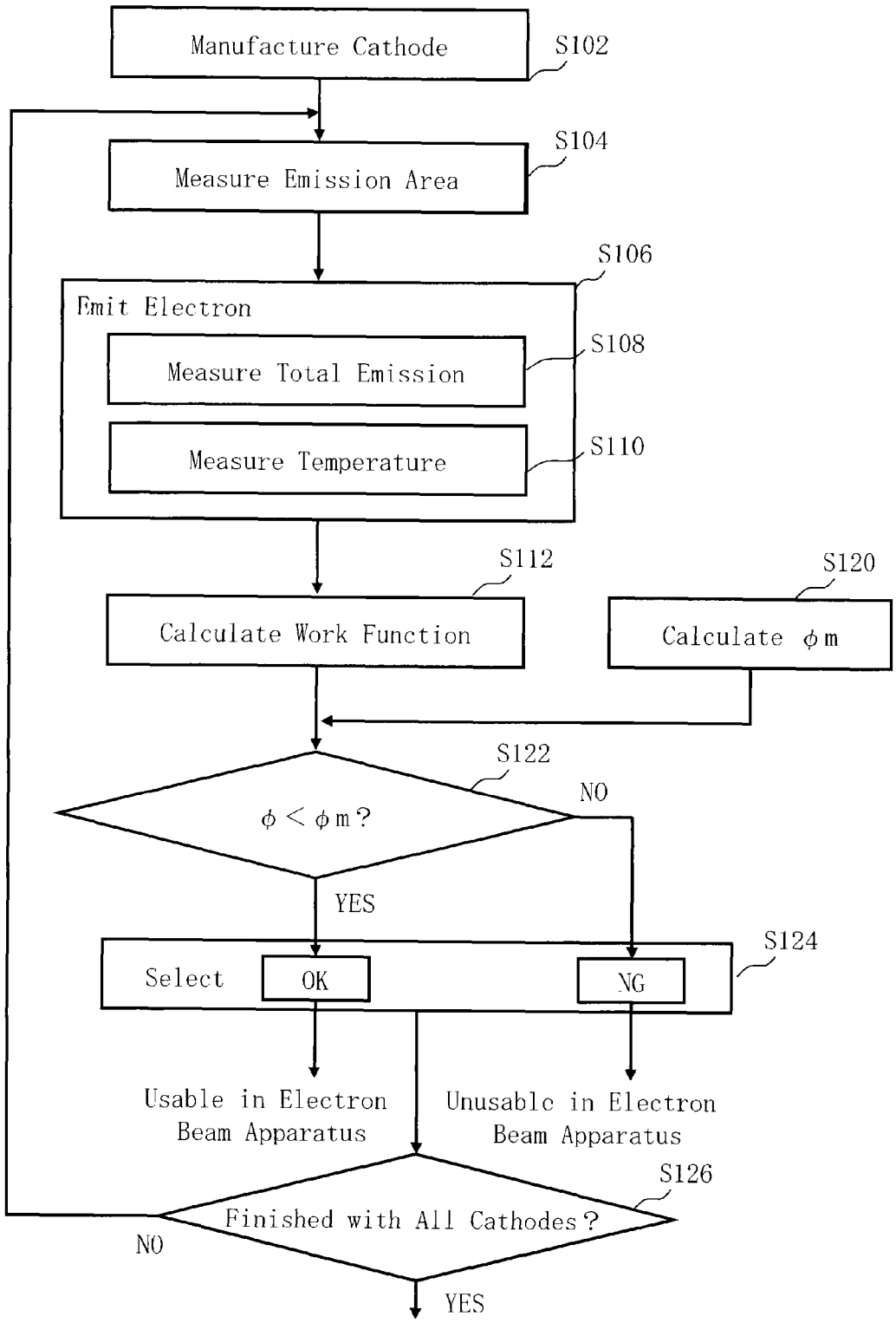
FIG. 1 is a flowchart illustrating principal steps in a cathode selection method according to Embodiment 1.

Hereinafter, a method for selecting a cathode with which desired value of brightness can be obtained is described in embodiments below.

Embodiment 1

Brightness B of a thermionic emission type cathode using, for example, a lanthanum hexaboride ($LaB_6$) crystal and the like can be defined by a Langmuir's formula (1) using a current density J of an electron emission surface, a cathode temperature T, a Boltzmann constant k, an elementary charge e, and an accelerating voltage V.

$$B=JeV/(\pi kT) \quad (1)$$

Therefore, in order to increase brightness, it is apparent that the current density J of the electron emission surface needs to be increased. Furthermore, the current density J of the electron emission surface in Formula (1) can be defined by a following Richardson Dash Man's formula (2) by using work function ($\phi$), a Richardson constant A, the cathode temperature T, and the Boltzmann constant k.

$$J=AT^2\exp(-\phi/kT) \quad (2)$$

The Richardson constant A is theoretically 120 $A/cm^2K^2$ for the $LaB_6$ crystal, for example; however, it is known that actually about 80 $A/cm^2K^2$ is appropriate. From Formula (2), in order to increase the current density J of the electron emission surface, or in other words, in order to increase the brightness, it is apparent that the work function $\phi$ needs to be decreased. However, it is not easy to decrease the work function $\phi$. Heretofore, there has been no method of reducing the work function that can be applied to cathode manufacturing at a practical use level. Furthermore, as described above, in a $LaB_6$ crystal, for example, manufactured by the zone melting method and the like, a composition ratio of the lanthanum (La) and the boron (B), the impurity density, and the like are different depending on the position within the crystal. Therefore, even in a case where the plurality of cathodes is manufactured from the same mass of crystal, the work function obtained may vary for each completed cathode. Furthermore, since the current density J of the electron emission surface can be defined as a value obtained by dividing a total emission I by an area S of the electron emission surface, by transforming Formula (2), the work function $\phi$ can be defined by Formula (3), which is a transformed formula of the following Richardson Dash Man formula.

$$\phi=-kT\cdot In\{I/(SAT^2)\} \quad (3)$$

Therefore, focusing on such a variation in the work function, a cathode is selected by a value of the work function in Embodiment 1.

FIG. 1 is a flowchart illustrating principal steps in a cathode selection method according to Embodiment 1. As in FIG. 1, in the cathode selection method according to Embodiment 1, a series of steps are performed including: cathode manufacturing (S102), emission area measuring (S104), electron emitting (S106), work function calculating (S112), and acceptable value calculating (S120), determining (S122), selecting (S124), and determining (S126). Furthermore, in the electron emitting (S106), total emission measuring (S108) and temperature measuring (S110) are performed.

In the cathode manufacturing (S102), first, a cathode to be selected is manufactured. The cathode to be manufactured is formed into a shape in which the electron emission surface is a flat surface and an emission area is limited. In other words, an emission area limited type cathode having a flat electron emission surface is manufactured. In the cathode manufacturing, a mass of $LaB_6$ crystal, for example, is manufactured by the zone melting method and the like. Then, the plurality of cathodes is manufactured by processing the mass. Here, the cathodes to be manufactured may be formed from the same crystal or from different crystals.

Figure 2:
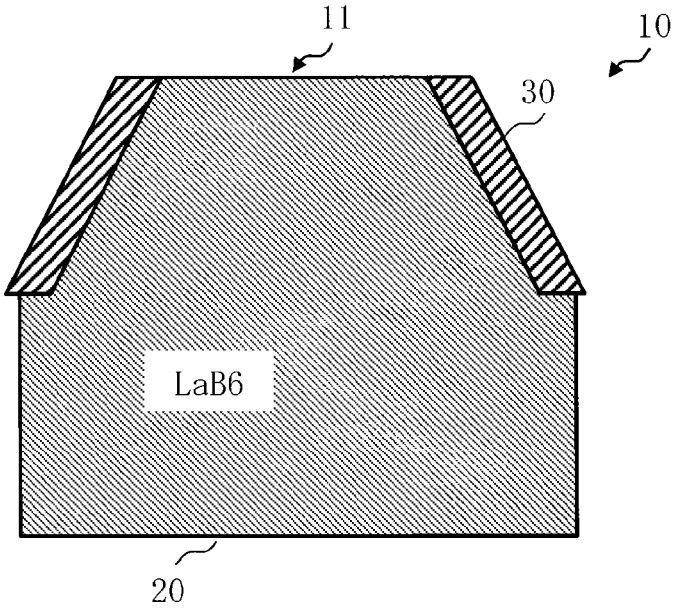
FIG. 2 is a sectional view illustrating one example of a cathode according to Embodiment 1.

FIG. 2 is a sectional view illustrating one example of a cathode according to Embodiment 1. In FIG. 2, a cathode 10 is formed by tapering an upper part of, for example, a cylindrical $LaB_6$ crystal 20 and by processing a top surface 11 thereof to be a flat surface. Then, for example, a carbon film 30 is displaced on an entire upper side surface that has been tapered. As described below, since a lower part of the $LaB_6$ crystal 20 is covered by a heater and the like, the top surface 11 formed into the flat surface is an only part exposed when heated, whereby it is possible to limit the electron emission surface to the exposed top surface 11. Therefore, the electron emission area can be limited to the area S of the top surface 11.

Figure 3:
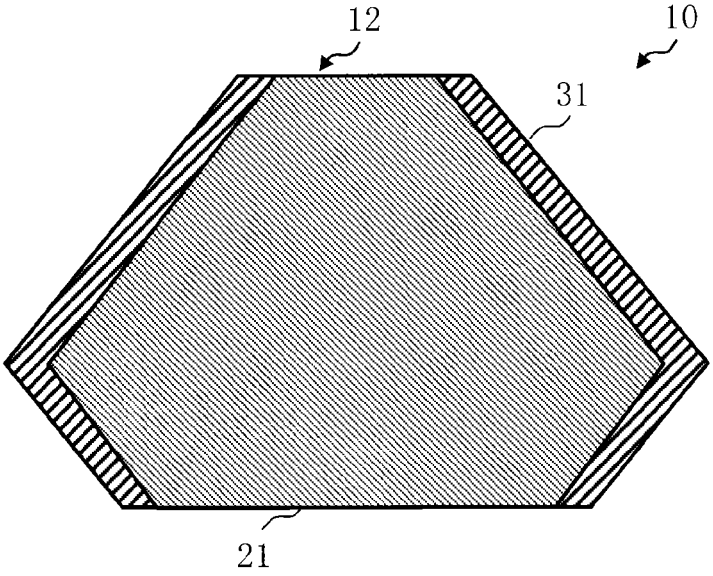
FIG. 3 is a sectional view illustrating another example of the cathode according to Embodiment 1.

FIG. 3 is a sectional view illustrating another example of the cathode according to Embodiment 1. In FIG. 3, the cathode 10 is formed by processing a top surface 12 of a $LaB_6$ crystal 21 having a hexagonal cross-section, for example, into a flat surface. Then, a carbon film 31 is displaced on entire side surfaces. Even in such a configuration, a part to be exposed when heated is only the top surface 12 formed into the flat surface, whereby it is possible to limit the electron emission surface to the exposed top surface 12. Therefore, the electron emission area can be limited to the area S of the top surface 12.

Figure 4:
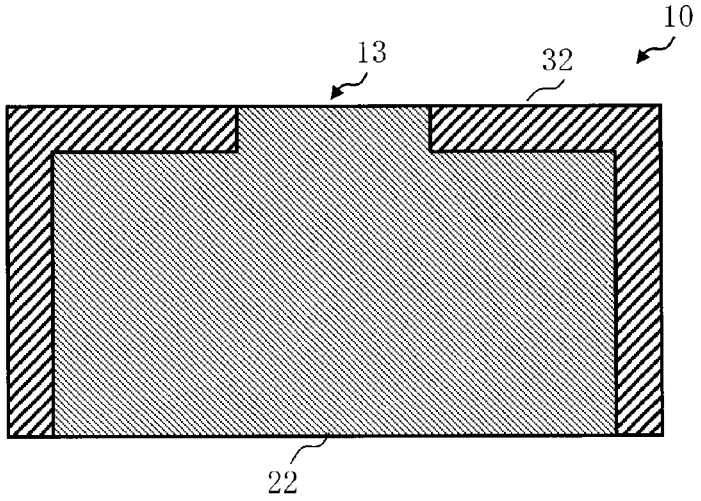
FIG. 4 is a sectional view illustrating another example of the cathode according to Embodiment 1.

FIG. 4 is a sectional view illustrating another example of the cathode according to Embodiment 1. In FIG. 4, the cathode 10 is formed by providing a projection portion at a center of an upper part of a $LaB_6$ crystal 22, and a carbon film 32 is displaced on entire surfaces except for a top surface 13 of the projection portion. The top surface 13 of the projection portion is processed into a flat surface. In such a configuration as well, a part exposed when heated is only the top surface 13 formed into the flat surface, whereby it is possible to limit the electron emission surface to the exposed top surface 13. Therefore, the electron emission area can be limited to the area S of the top surface 13.

Figure 5A:
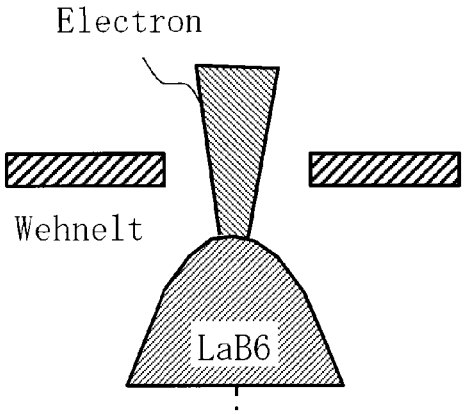
FIGS. 5A and 5B are conceptual diagrams illustrating one example and a comparative example of an electron emission surface of the cathode according to Embodiment 1.
Figure 5B:
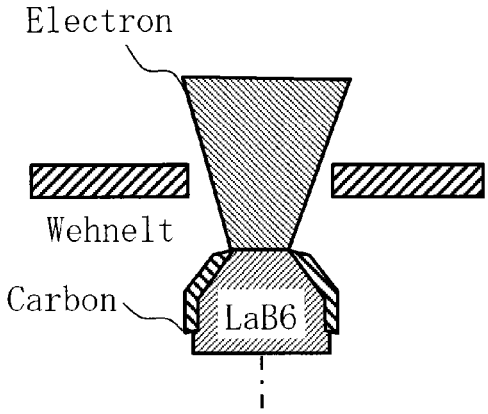

FIGS. 5A and 5B are conceptual diagrams illustrating one example and a comparative example of an electron emission surface of the cathode according to Embodiment 1. In Formula (3), in order to precisely calculate the work function $\phi$, it is necessary to precisely measure the area S of the electron emission surface. As illustrated in FIG. 5A, in a cathode configured to have no limitation on an exposed surface of the $LaB_6$ crystal, an area of the electron emission surface is changed by the cathode temperature and a Wehnelt voltage (bias voltage). Therefore, it is not possible to accurately obtain the work function $\phi$. In contrast, as illustrated in FIG. 5B, in a cathode configured to have an exposed surface of the $LaB_6$ crystal limited only to a top surface, which is a flat surface, regardless of the cathode temperature or the Wehnelt voltage (bias voltage), electrons are emitted from the emission surface nearly uniformly. Actually, an electric field distribution on the emission surface does not become completely uniform, whereby a current density distribution may not be completely uniform. However, it is known through an experiment and the like that an effective and precise comparison of the work function $\phi$ can be made if the total emission and the emission area can be precisely measured.

Therefore, in Embodiment 1, as described above, the cathode 10 having a shape in which the electron emission surface is flat and the emission area is limited is used.

In the emission area measuring (S104), for the plurality of manufactured cathodes, the emission area of the top surface 11 (12, 13) to be the electron emission surface is measured by using an optical microscope.

Figure 6:
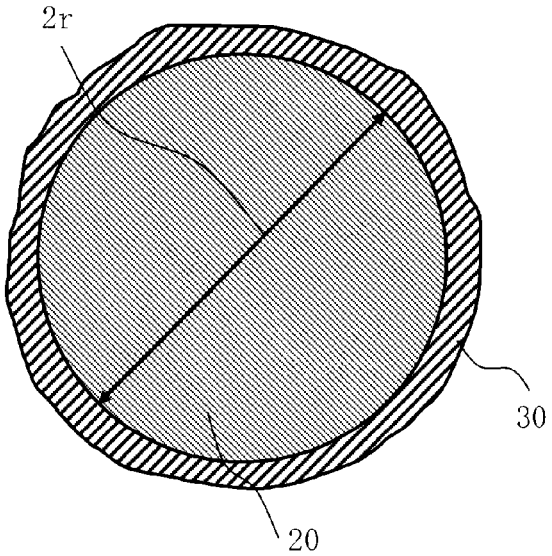
FIG. 6 is a view illustrating one example of the electron emission surface according to Embodiment 1 imaged by an optical microscope.

FIG. 6 is a view illustrating one example of the electron emission surface according to Embodiment 1 imaged by the optical microscope. The carbon film 30 is disposed around the $LaB_6$ crystal 20 to be an axis. An area S can be calculated by measuring a radius or a diameter of the $LaB_6$ crystal 20. Furthermore, since the top surface is a flat surface, it is possible to precisely calculate the area.

In the electron emitting (S106), a parameter for obtaining work function is measured by allowing each of the manufactured cathodes to emit electrons.

Figure 7:
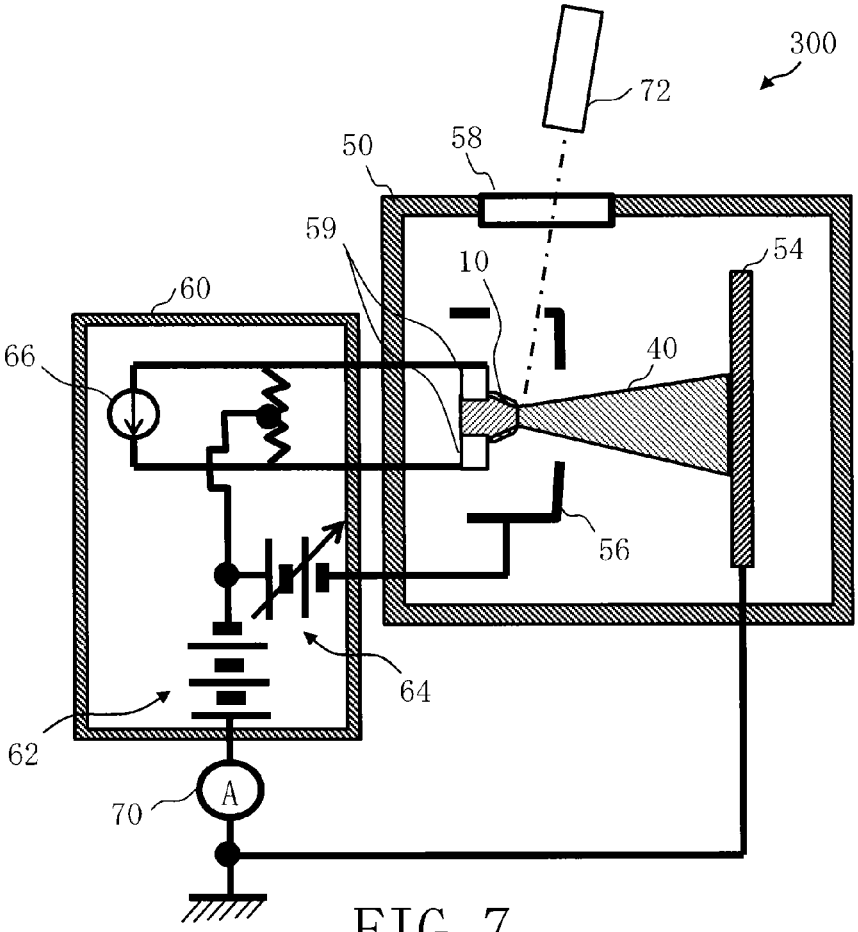
FIG. 7 is a conceptual diagram illustrating a device configuration of a parameter measurement device for acquiring work function according to Embodiment 1.

FIG. 7 is a conceptual diagram illustrating a device configuration of a parameter measurement device for obtaining work function according to Embodiment 1. In FIG. 7, a measurement device 300 includes a vacuum case 50, an electron gun assembly power source 60, and an ammeter 70. Inside the electron gun assembly power source 60, an accelerating voltage power source 62, a Wehnelt power source 64, and a heater power source 66 are disposed. A negative pole (−) side of the accelerating voltage power source 62 is connected to the cathode 10 inside the vacuum case 50. A positive pole (+) side of the accelerating voltage power source 62 is connected to an anode electrode 54 inside the vacuum case 50 and is grounded. Furthermore, the ammeter 70 is connected in series between the positive pole (+) of the accelerating voltage power source 62 and the anode electrode 54. Furthermore, the negative pole (−) of the accelerating voltage power source 62 branches off and is also connected to a positive pole (+) of the Wehnelt power source 64, while a negative pole (−) of the Wehnelt power source 64 is connected to a Wehnelt 56 disposed between the cathode 10 and the anode electrode 54. Furthermore, inside the vacuum case 50, a part on the opposite side of the electron emission surface of the cathode 10 and not covered with a carbon film is covered by a heater 59. Then, the heater power source 66 is connected to the heater 59. To the Wehnelt 56, an opening, through which the electrons emitted from the electron emission surface of the cathode 10 pass to a side of the anode electrode 54, is formed. In a state where a fixed negative Wehnelt voltage (bias voltage) is applied from the Wehnelt power source 64 to the Wehnelt 56, and a fixed negative accelerating voltage is applied from the accelerating voltage power source 62 to the cathode 10, when the cathode 10 is heated by the heater 59, the electrons (electron swarm) are emitted from the cathode 10. The emitted electrons (electron swarm) become an electron beam being accelerated by the accelerating voltage, and advances toward the anode electrode 54. Here, the total emission I is measured by changing the cathode temperature T in a state where the accelerating voltage and the Wehnelt voltage are each set to a fixed value.

In the total emission measuring (S108), using the measurement device 300, a total emission (or "total emission current") when the electron beam is emitted from the cathode 10 to the anode electrode 54 is measured by the ammeter 70. By measuring a current in the accelerating voltage power source 62, the cathode 10, the anode electrode 54, and series circuits connecting to the accelerating voltage power source 62 with the ammeter 70, it is possible to measure the total emission emitted from the cathode 10. Measuring a current value of such circuits with the ammeter 70 is easier and more precise than measuring a current of the electron beam itself with a detector such as a Faraday cup.

As temperature measuring (S110), a temperature of the electron emission surface of the cathode 10 is measured when the electrons are emitted from the cathode 10. To the vacuum case 50, a window 58 (viewing port) through which inside thereof can be directly viewed from outside is disposed. It is preferred that the window 58 be disposed at a position where the electron emission surface of the cathode 10 can be directly viewed. Accordingly, the temperature of the electron emission surface when the electrons are emitted can be measured. In an example in FIG. 7, the opening is formed in a side surface of the Wehnelt 56, and through the opening in the Wehnelt 56, the electron emission surface of the cathode 10 can be directly viewed from the window 58. Outside the vacuum case 50, a pyrometer 72 (a temperature measurement device) is displaced in the vicinity of the window 58. Accordingly, from outside the vacuum case 50, the temperature of the electron emission surface of the cathode 10 can be measured with the pyrometer 72. With regard to the temperature of the cathode, a temperature within a temperature limited region is measured.

Figure 8:
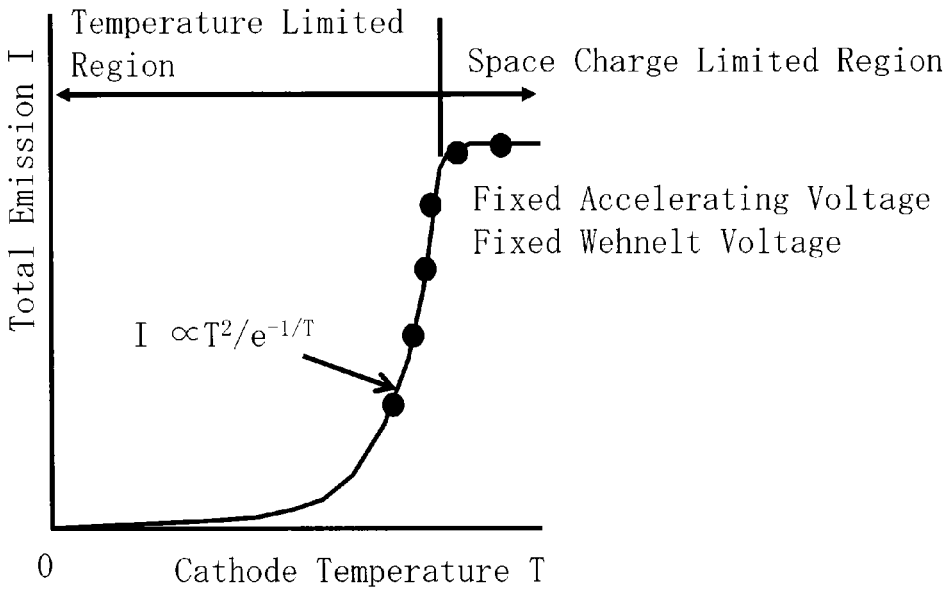
FIG. 8 is a graph illustrating a relationship between a total emission and a cathode temperature according to Embodiment 1.

FIG. 8 is a graph illustrating a relationship between the total emission and the cathode temperature according to Embodiment 1. The total emission I of electrons is expressed in a vertical axis, and a cathode temperature T is expressed in a horizontal axis. By replacing the current density J with the total emission I and the area S of the electron emission surface, and by transforming the Richardson Dash Man's formula (2), the total emission I can be defined by the following formula (4), which is a transformed formula of the Richardson Dash Man's formula.

$$I=SAT^2\exp(-\phi/kT) \quad (4)$$

In a cathode 10 having a certain work function ϕ, the area S of the electron emission surface is fixed. Therefore, when the cathode temperature T is raised, the total emission I increases following the Richardson Dash Man's formula (4) as illustrated in FIG. 8. However, when the cathode temperature T is further raised, the total emission I moves from the temperature limited region to a space-charge region, and in the space-charge region, it becomes a fixed value.

Figure 9B:
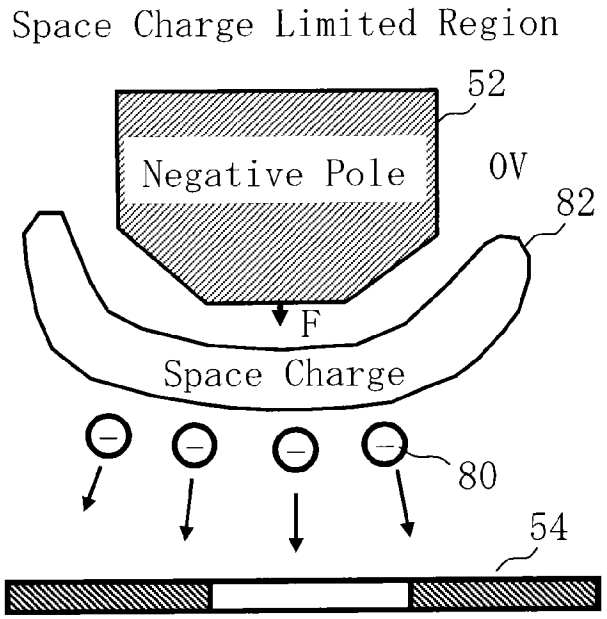
FIGS. 9A and 9B are conceptual diagrams for describing a temperature limited region and a space-charge region according to Embodiment 1.
Figure 9A:
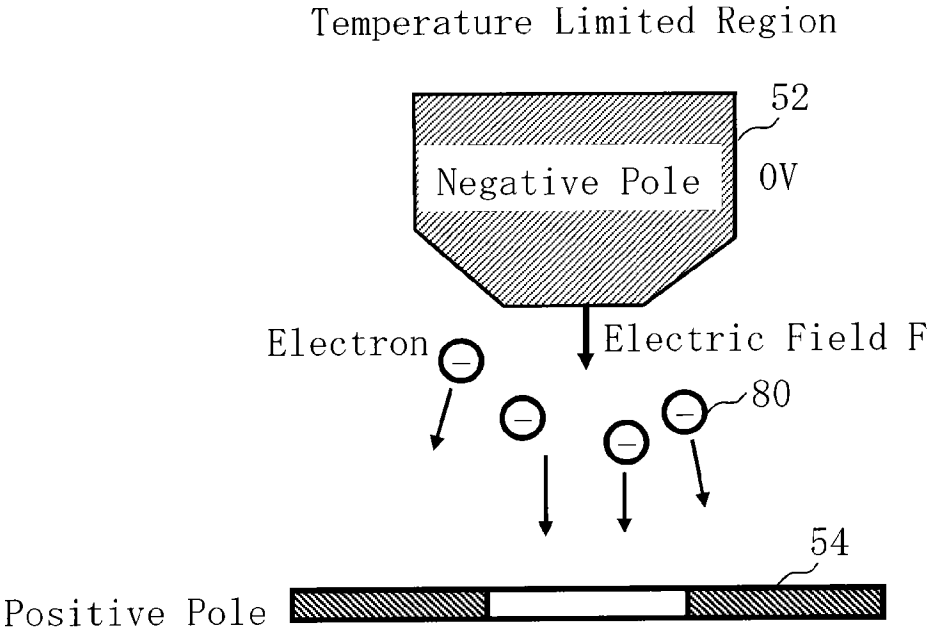

FIGS. 9A and 9B are conceptual diagrams for describing the temperature limited region and the space-charge region according to Embodiment 1. In a case where the cathode temperature is lower than a certain limitation value, as illustrated in FIG. 9A, all electrons emitted from a cathode 52 advance in a direction of the anode electrode 54. In such a state, the number of electrons emitted becomes a function of a cathode temperature. In other words, a Richardson Dash Man's formula becomes true. A cathode temperature region in such a state is the temperature limited region. In contrast, when the cathode temperature becomes higher and exceeds the limitation value, as illustrated in FIG. 9B, the number of electrons emitted from the cathode 52 increases, and an electron cloud called a space charge 82 is formed in front of the cathode 52. The space charge 82 causes a negative feedback effect to an electron emission phenomenon from the cathode 52. In such a state, the number of electrons emitted no longer depends on the cathode temperature. A cathode temperature region in such a state is a space-charge region. In Embodiment 1, the cathode temperature is measured within the temperature limited region where the Richardson Dash Man's formula is true.

Figure 10:
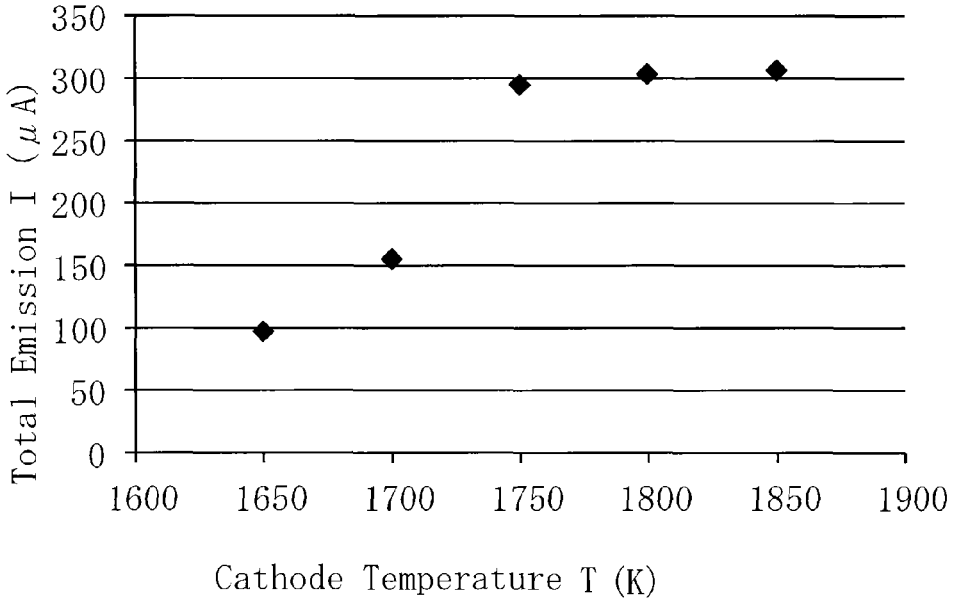
FIG. 10 is a graph illustrating one example of a measurement result of the total emission and the cathode temperature and a relationship therebetween according to Embodiment 1.

FIG. 10 is a graph illustrating one example of a measurement result of the total emission and the cathode temperature and a relationship therebetween according to Embodiment 1. The total emission I of electrons is expressed in a vertical axis, and the cathode temperature T is expressed in a horizontal axis. One example of a result where an output of the accelerating voltage power source is set to 10 kV, for example, and the Wehnelt voltage is set to 0.5 kV is illustrated herein. As illustrated in FIG. 10, the total emission I is measured by varying the cathode temperature T to 1650 K, 1700 K, 1750 K, 1800 K, and 1850 K. As a result, the total emission I gradually increases and becomes a fixed value once exceeding 1750 K. Therefore, a measurement result of the total emission I for 1750 K or under is used in calculation of the work function.

In the work function calculating (S112), the work function is calculated by the Richardson Dash Man's formula by using a measured total emission I value. Here, Formula (3) described above may be used.

Figure 11:
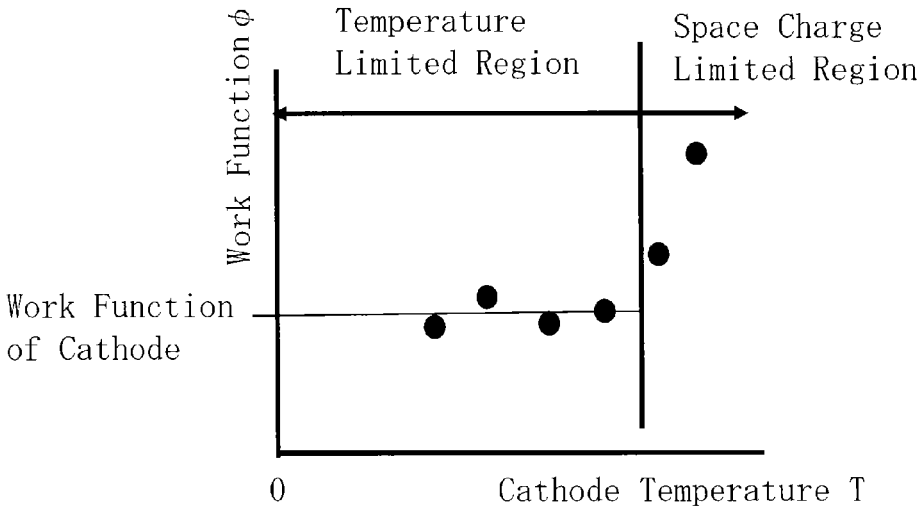
FIG. 11 is a graph illustrating a relationship between work function and a cathode temperature according to Embodiment 1.

FIG. 11 is a graph illustrating a relationship between the work function and the cathode temperature according to Embodiment 1. The work function ϕ of the cathode is expressed in a vertical axis, and a cathode temperature T is expressed in a horizontal axis. The work function ϕ of the cathode may be measured by substituting the area S of the electron emission surface, the cathode temperature T, and the total emission I that are measured into Formula (3), which is a transformed formula of the Richardson Dash Man's formula. As illustrated in FIG. 11, within the temperature limited region, the work function ϕ is fixed within a margin of a measurement error. On the other hand, within the space-charge region, apparently the work function ϕ increases with an increase of the cathode temperature as it no longer follows the Richardson Dash Man's formula. Therefore, in Embodiment 1, a fixed value within the temperature limited region may be used as the work function ϕ of the cathode.

Figure 12:
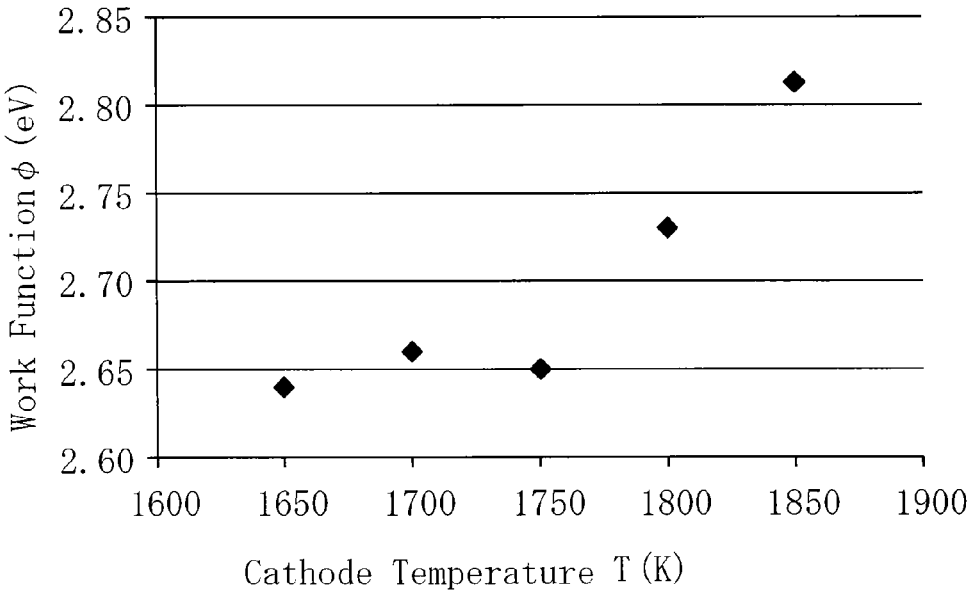
FIG. 12 is a graph illustrating one example of a measurement result of the work function and the cathode temperature and the relationship therebetween according to Embodiment 1.

FIG. 12 is a graph illustrating one example of a measurement result of the work function and the cathode temperature and the relationship therebetween according to Embodiment 1. The work function ϕ of the cathode is expressed in a vertical axis, and a cathode temperature T is expressed in a horizontal axis. In FIG. 12, one example of the work function ϕ calculated from the measurement result illustrated in FIG. 10 is illustrated. As illustrated in FIG. 12, the work function ϕ is calculated by varying the cathode temperature T to 1650 K, 1700 K, 1750 K, 1800 K, and 1850 K. As a result, the work function ϕ indicates a fixed value within a margin of an error, and increases once exceeding 1750 K. Therefore, in Embodiment 1, a calculation result of the work function ϕ for 1750 K or under is used.

In Embodiment 1, an average value of a plurality of calculation results of the work function ϕ within the temperature limited region becomes a value of the work function ϕ of the cathode. Accordingly, an error can be minimized. Note, however, that it is not limited to this value, and as long as an error is within an allowable range, a value of the work function ϕ of the cathode calculated from the total emission I at one point of the cathode temperature within the temperature limited region may also be used.

In the acceptable value calculating (S120), an acceptable value ϕm of the work function ϕ for obtaining a desired value of brightness B is calculated. As the acceptable value ϕm, work function value for obtaining the desired value of brightness B that satisfies the Langmuir formula (1) is used.

Figure 13:
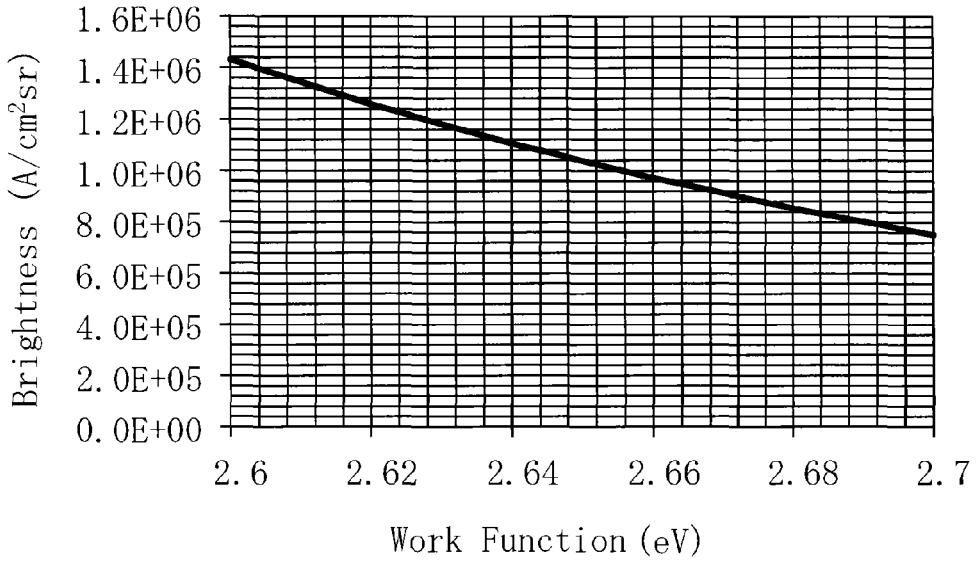
FIG. 13 is a view illustrating one example of a relationship between brightness and the work function according to Embodiment 1.

FIG. 13 is a view illustrating one example of a relationship between the brightness and the work function according to Embodiment 1. In FIG. 13, the brightness B is expressed in a vertical axis, and the work function ϕ is expressed in a horizontal axis. For example, for the brightness B desired to be used in an electron beam lithography apparatus (or "writing apparatus") and the like, work function value that satisfies the Langmuir formula (1) is calculated. By transforming Formula (2), the work function ϕ can be defined by Formula (5), which is a transformed formula of the following Richardson Dash Man's formula.

$$\phi=-kT\cdot In\{J/(AT^2)\} \quad (5)$$

On the other hand, by transforming the Langmuir's formula (1), the current density J can be defined by the following Formula (6).

$$J=\pi kTB/(eV) \quad (6)$$

By substituting Formula (6) into Formula (5), an upper limit of the work function ϕ, which satisfies the brightness B by the Langmuir's formula (1), can be obtained. For example, in a case where the brightness B of $1.2\times10^6$ A/cm$^2$sr or more is required, the upper limit of the work function becomes 2.628 eV. Therefore, the acceptable value ϕm under such condition becomes 2.628 eV.

As a determining (S122), it is determined whether or not the cathode to be measured is a cathode having the small work function ϕ of the acceptable value ϕm or under.

In the selecting (S124), as a result of the determining, in a case where the cathode to be measured has the work function ϕ of the acceptable value ϕm or under, it is selected as a usable cathode (ok). As a result of the determining, in a case where the work function ϕ is larger than the acceptable value ϕm, it is selected as an unusable cathode (NG).

In the determining (S126), it is determined if the selecting has been performed on all of the manufactured cathodes. In a case where the selecting has not been performed on all of the manufactured cathodes, a process returns to the emission area measuring (S104), and the process from the emission area measuring (S104) to the determining (S126) is repeated until the selecting is performed on all of the manufactured cathodes. When the selecting is performed on all of the manufactured cathodes, the process ends.

Here, the emission area measuring (S104), the electron emitting (S106), the work function calculating (S112), the determining (S122), and the selecting (S124) may be performed on all of the manufactured cathodes before proceeding to the next step.

Figure 14:
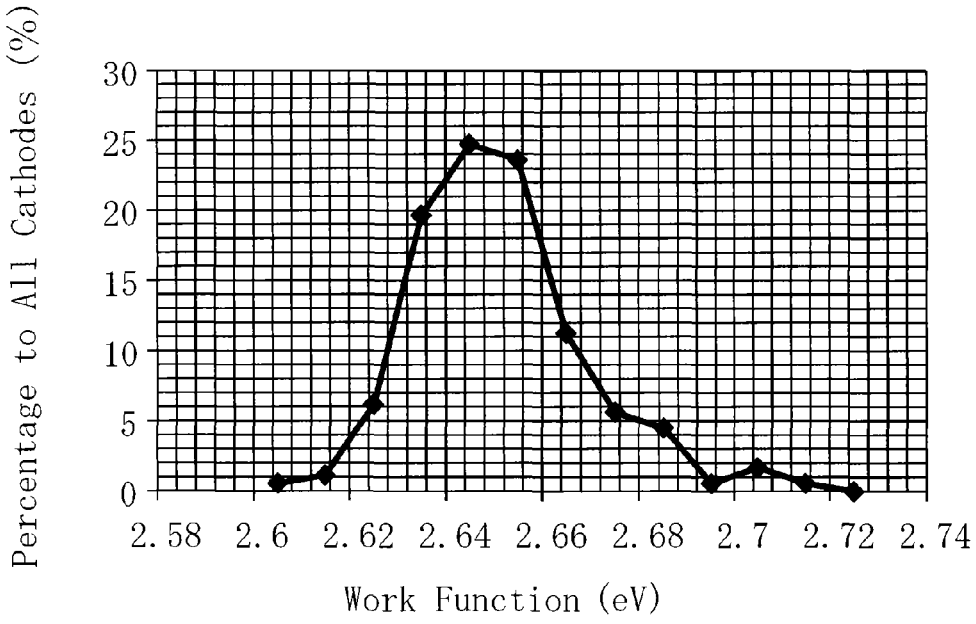
FIG. 14 is a view illustrating one example of a relationship between a percentage to all cathodes and the work function according to Embodiment 1.

FIG. 14 is a view illustrating one example of a relationship between a percentage to all cathodes and the work function according to Embodiment 1. It illustrates one example of a result of calculating the above-described work function for all of the manufactured cathodes. As illustrated in FIG. 14, it is apparent that there is a variation in a value of the work function, which is a characteristic of the cathodes to be manufactured. For example, cathodes having the above-described work function $\phi$ of 2.628 eV or under occupy only a few percentages of all of the manufactured cathodes. Therefore, even in a case where a large number of cathodes are manufactured, a percentage of cathodes usable in an electron beam lithography apparatus, in which high brightness is required along with the recent miniaturization of a pattern, is small. Therefore, it is necessary to efficiently select such a few cathodes. Therefore, it is significant to select using the selection method according to Embodiment 1.

As above, according to Embodiment 1, it is possible to select the cathode with which the desired value of brightness B can be obtained. Therefore, a high brightness-capable cathode can be obtained.

Figure 15:
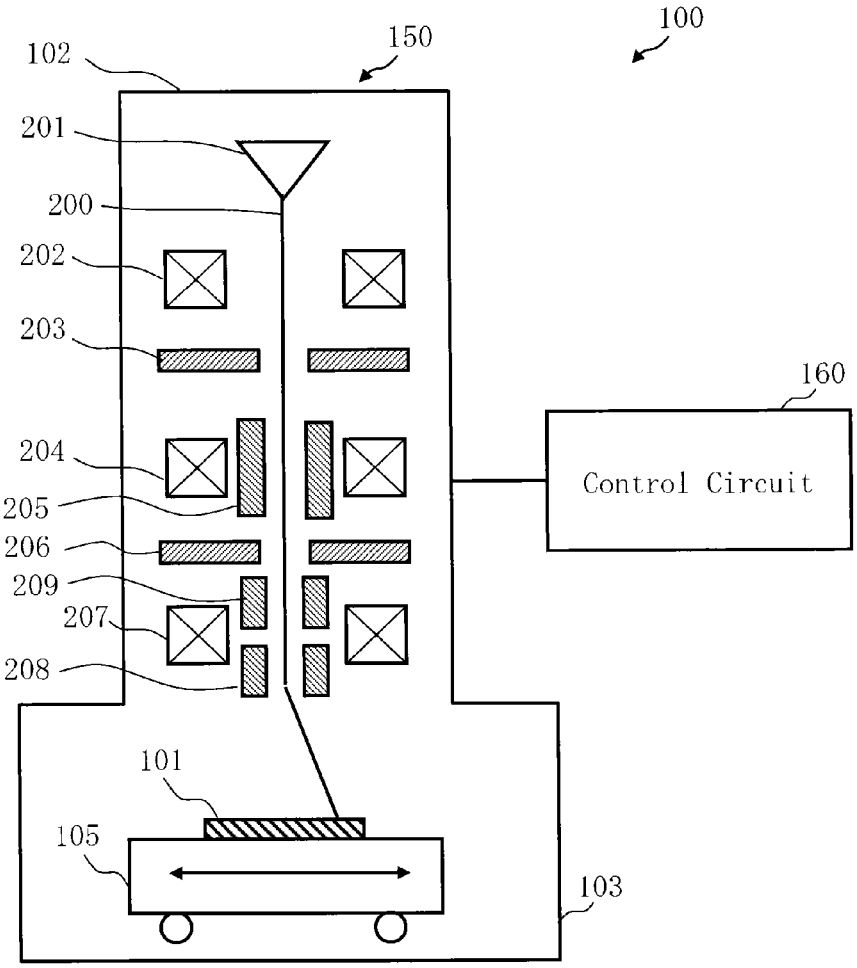
FIG. 15 is a conceptual diagram illustrating a configuration of a lithography apparatus incorporating a selected cathode according to Embodiment 1.

FIG. 15 is a conceptual diagram illustrating a configuration of a lithography apparatus incorporating a selected cathode according to Embodiment 1. Here, an electron beam lithography apparatus is illustrated as one example of an electron beam apparatus incorporating a selected cathode. In FIG. 15, a lithography apparatus 100 (or "writing apparatus") includes a pattern writing unit 150 and a control circuit 160. The lithography apparatus 100 is one example of the electron beam lithography apparatus. More specifically, it is one example of a variable-shaped type lithography apparatus. The pattern writing unit 150 includes an electron lens-barrel 102 and a pattern writing chamber 103. Inside the electron lens-barrel 102, an electron gun assembly 201 incorporating a selected cathode, a lighting lens 202, a first aperture plate 203, a projector lens 204, a deflector 205, a second aperture plate 206, an object lens 207, a main deflector 208 and a sub deflector 209 are disposed. Inside the pattern writing chamber 103, an XY stage 105 is disposed. On the XY stage 105, a target object 101, such as a mask, to be a target of pattern writing during writing, is disposed. In the target object 101, an exposure mask for manufacturing a semiconductor device is included. Furthermore, in the target object 101, a mask blank having a resist applied thereon and nothing written thereon is included. In the electron gun assembly 201, the selected cathode 10 according to Embodiment 1 is incorporated.

An electron beam 200 emitted from the electron gun assembly 201 (emission unit) lights up, by the lighting lens 202, the entire first aperture plate 203 having a rectangular hole. Here, the electron beam 200 is first shaped into a rectangular shape. Then, the electron beam 200 having a first aperture plate image, which has passed through the first aperture plate 203, is projected on a second aperture plate 206 by the projector lens 204. By the deflector 205, the first aperture plate image on the second aperture plate 206 is deflected and controlled, whereby a beam shape and a size can be varied (variable-shaped). Then, the electron beam 200 of a second aperture plate image, which has passed through the second aperture plate 206, is focused by the object lens 207, is deflected by the main deflector 208 and the sub deflector 209, and is radiated onto a desired position of a target object 101 disposed on the continuously moving XY stage 105. In FIG. 1, a case in which multistage deflection, or a main and sub two-stage deflection, is used for positional deflection is illustrated. In such a case, the electron beam 200 of an appropriate shot may be deflected to a reference position of a subfield (SF), which is a stripe region virtually divided by using the main deflector 208, while following the stage movement, and a beam of the appropriate shot according to each radiation position within the SF may be deflected by using the sub deflector 209. Thus the lithography apparatus 100 writes a pattern on the target object 101, using an electron beam.

Since a selected high brightness cathode is incorporated, pattern writing can be performed with a desired value of brightness.

Embodiment 2

In Embodiment 1, a window is disposed to measure a temperature of an electron emission surface of a cathode in a lateral direction of an optical axis from a cathode to an anode, but it is not limited to this configuration. Contents are the same as those in Embodiment 1 except for those specifically described herein.

Figure 16:
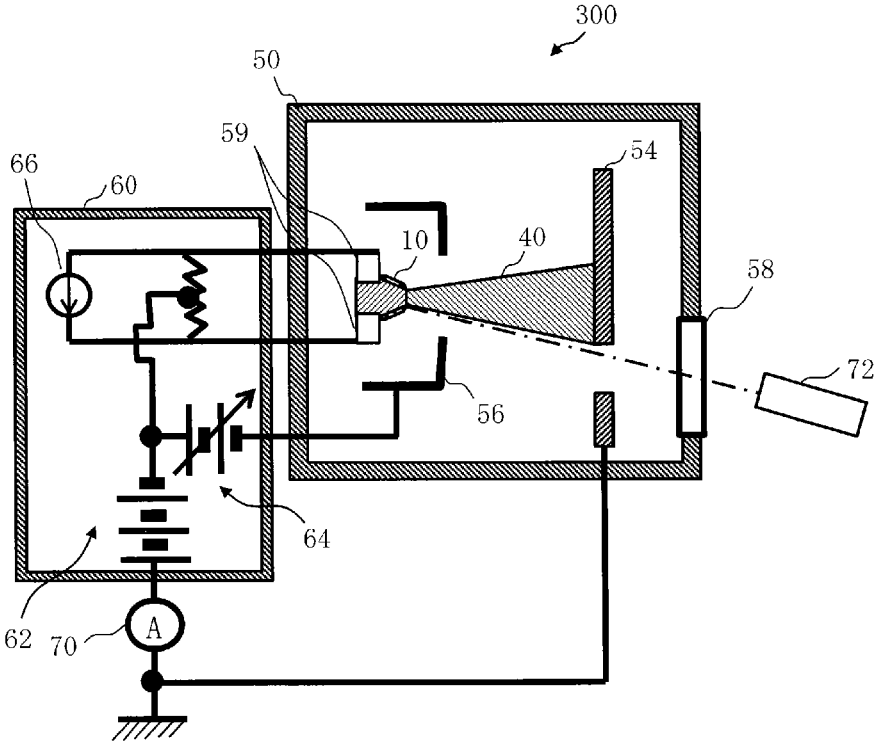
FIG. 16 is a conceptual diagram illustrating a device configuration of a parameter measurement device for acquiring work function according to Embodiment 2.

FIG. 16 is a conceptual diagram illustrating a device configuration of a parameter measurement device for obtaining work function according to Embodiment 2. FIG. 16 is the same as FIG. 7 except for a position where the window 58 is disposed and a member for forming an opening for avoiding a shield between the window 58 and an electron emission surface of the cathode 10. In FIG. 16, the window 58 is disposed in a wall surface of the vacuum case 50 on a back surface side of the anode electrode 54. By forming the opening in the anode electrode 54, it is possible to directly view the electron emission surface of the cathode 10 from the window 58 through the opening of the anode electrode 54. Outside the vacuum case 50, the pyrometer 72 (temperature measurement device) is displaced in the vicinity of the window 58. Accordingly, from outside the vacuum case 50, it is possible to measure the temperature of the electron emission surface of the cathode 10 by the pyrometer 72.

The same effect as Embodiment 1 can be realized by configuring as the above.

Embodiment 3

In Embodiments 1 and 2, a parameter measurement device 300 for obtaining work function is configured such that only one cathode 10 can be disposed; however, it is not limited to this configuration. In Embodiment 3, an example in which a plurality of cathodes is simultaneously displaced is described. Contents are the same as those in Embodiments 1 and 2 except for those specifically described herein.

Figure 17:
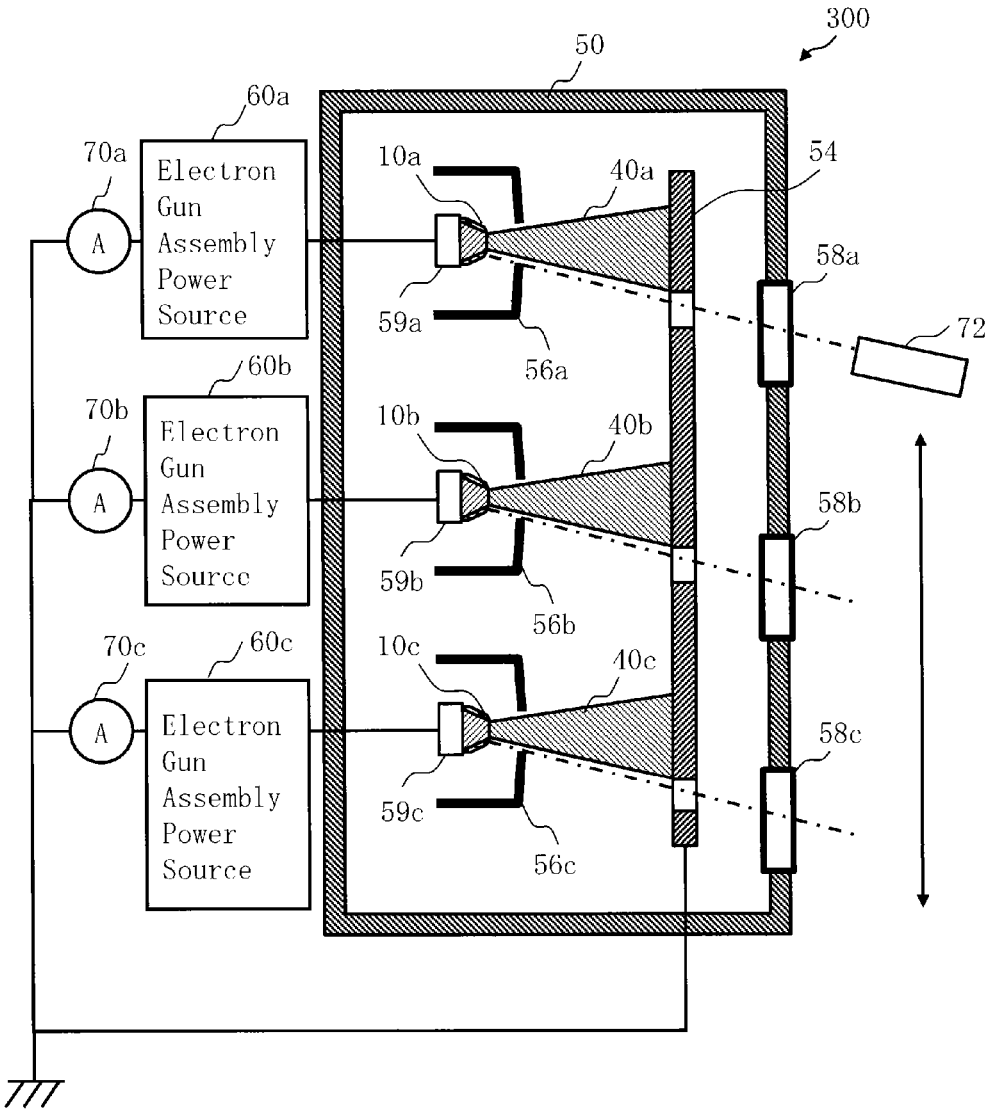
FIG. 17 is a conceptual diagram illustrating a device configuration of a parameter measurement device for acquiring work function according to Embodiment 3.
Figure 18:
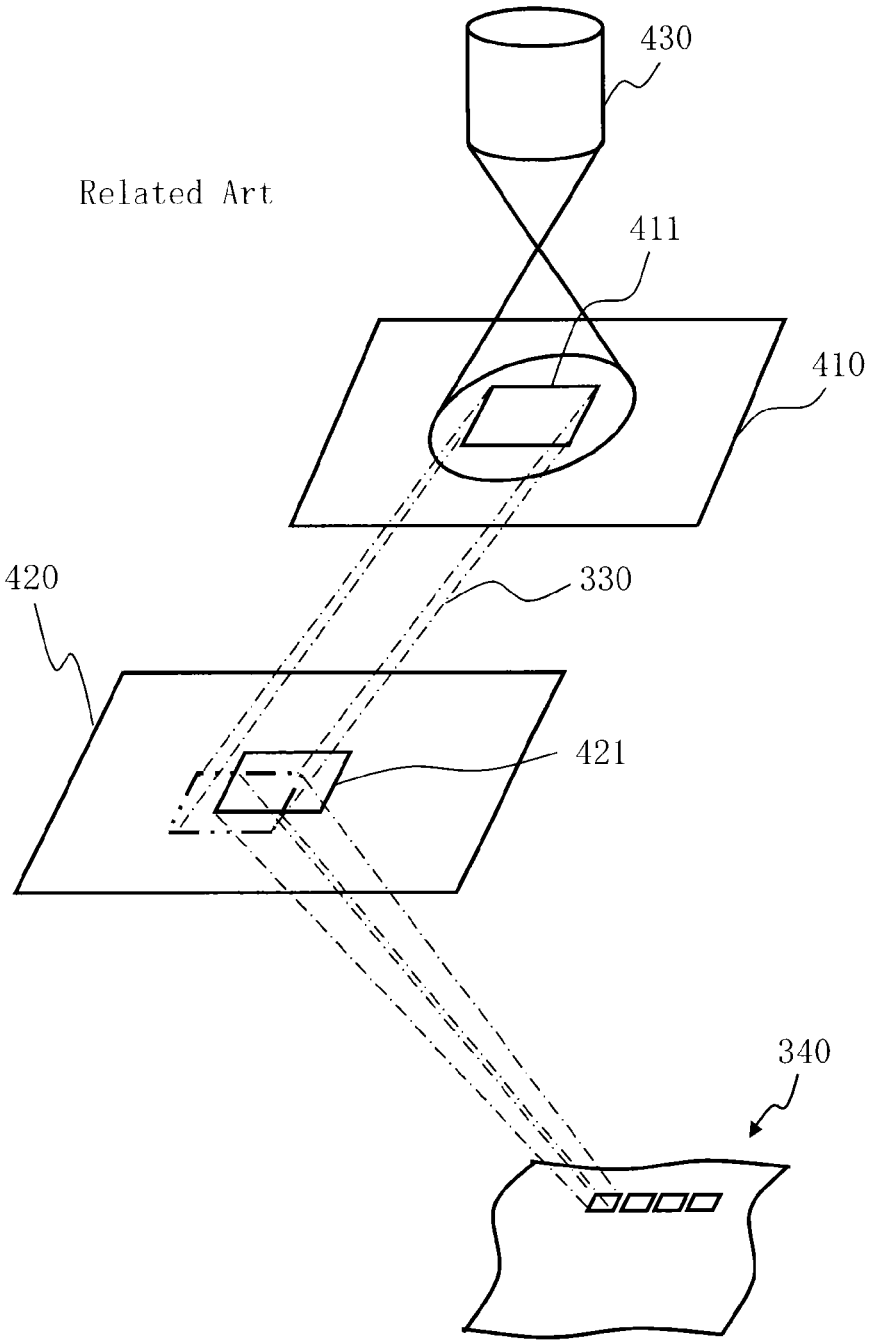
FIG. 18 is a conceptual diagram for describing an operation of a variable-shaped electron beam lithography apparatus.

FIG. 17 is a conceptual diagram illustrating a device configuration of the parameter measurement device for acquiring the work function according to Embodiment 3. In FIG. 17, the measurement device 300 according to Embodiment 3 has a plurality of cathodes 10 simultaneously displaced inside the vacuum case 50. The Wehnelt 56 is displaced for each of the cathode 10. Furthermore, the anode electrode 54 may be common. The electron gun assembly power source 60 and the ammeter 70 may be displaced for each of the cathodes 10. The accelerating voltage power source, not illustrated, within the electron gun assembly power source 60 and the cathode 10 are connected in parallel to the common anode electrode 54. By measuring a current of the accelerating voltage power source, not illustrated, inside the electron gun assembly power source 60, the cathode 10, the anode electrode 54, and circuits connected in series to the accelerating voltage power source by the ammeter 70, the total emission I emitted from each cathode 10 can be simultaneously measured. Note, however, that in an example in FIG. 17, the window 58 for measuring a temperature of each cathode is disposed in a wall surface of the vacuum case 50 on the back surface side of the anode electrode 54. Then, an opening is formed in the anode electrode 54, which shields between the corresponding window 58 and the cathode 10. Then, a common pyrometer 72 (temperature measurement device) is displaced outside the vacuum case 50. With respect to measuring of the cathode temperature, the temperature of the electron emission surface of the cathode 10 may be measured in order by the pyrometer 72 from outside the vacuum case 50 by moving the common pyrometer 72 when electrons are emitted from each cathode 10.

As above, the embodiments have been explained with reference to specific examples. However, the present disclosure is not to be limited to these specific examples. The electron beam apparatus incorporating a selected cathode is not to be limited to a lithography apparatus, and the embodiments can be applied to other electron beam apparatuses such as an electron microscope. Furthermore, the $LaB_6$ crystal has been used as an exemplary cathode material in the descriptions; however, the embodiments are also applicable in cases of other thermionic emission materials such as tungsten (W) and a hexaboride cerium ($CeB_6$). Furthermore, the carbon film has been used to limit the electron emission surface of the cathode; however, it is not to be limited to the carbon. It may also be a material having work function higher than the electron emission material such as rhenium (Re).

Although descriptions have been omitted for contents such as an apparatus configuration and a control method, which are not directly required for describing the present disclosure, a required apparatus configuration or a required control method may be arbitrarily selected and used. For example, descriptions have been omitted for a controller configuration for controlling the lithography apparatus 100; however, it is needless to say that a required controller configuration may be appropriately selected and used.

All cathode selection methods, measurement devices for cathode selection, and electron beam lithography apparatuses and methods provided with an element of the present disclosure and are appropriately design changeable by those skilled in the art are also included in the scope of the present disclosure.

Additional advantages and modification will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A cathode selection method comprising:

measuring, with an ammeter, a total emission emitted from a cathode having an electron emission surface which is a flat surface and a emission area which is limited;

measuring, with a temperature measurement device, a temperature of the electron emission surface of the cathode when electrons are emitted from the cathode;

calculating a work function by a Richardson Dash Man's formula based on the total emission value measured with the ammeter, the temperature measured with the temperature measurement device and an emission area of an electron emission surface of the cathode; and determining whether or not the cathode whose the total emission value has been measured with the ammeter and whose the temperature has been measured with the temperature measurement device has the work function equal to or less than an acceptable value.

2. The method according to claim 1, wherein the acceptable value is a work function value with which a desired value of brightness satisfying a Langmuir's formula can be obtained.

3. The method according to claim 1, further comprising:

measuring the emission area by using an optical microscope.

4. The method according to claim 1, wherein the temperature of the electron emission surface of the cathode is measured within a temperature limited region.

5. The method according to claim 1, further comprising:

calculating an acceptable value of the work function with which a desired value of brightness can be obtained.

6. The method according to claim 1, further comprising:

selecting, as a result of determining and in a case where the work function of the cathode to be measured is equal or less than the acceptable value, the cathode as a usable cathode; and selecting, as a result of determining and in a case where the work function of the cathode to be measured is larger than the acceptable value, the cathode as an unusable cathode.

7. The method according to claim 1, wherein a cathode includes an upper part of a cylindrical crystal using a tapered thermionic emission material, and a top surface thereof processed into a flat surface.

8. The method according to claim 7, wherein a film, using a material having work function higher than an electron emission material, is disposed on an entire tapered side surface of an upper part of the cathode.

9. The method according to claim 8, wherein either a carbon (C) or a rhenium (Re) is used as the material of the film.

10. An electron beam lithography apparatus comprising:

an electron gun assembly incorporating a cathode selected by a cathode selection method according to claim 1; and a deflector configured to deflect an electron beam emitted from the electron gun assembly.

11. An electron beam writing method comprising:

emitting an electron beam from an electron gun assembly incorporating a cathode selected by a cathode selection method according to claim 1; and deflecting the electron beam emitted from the electron gun assembly onto a target object.

12. A cathode selection method comprising:

manufacturing a cathode to be selected, the cathode having an electron emission surface which is a flat surface and a emission area which is limited;

measuring, with an optical microscope, an emission area of an electron emission surface of the cathode;

measuring, with an ammeter, a total emission emitted from the cathode;

measuring, with a temperature measurement device, a temperature of the electron emission surface of the cathode when electrons are emitted from the cathode;

calculating, based on the total emission value measured with the ammeter, the temperature measured with the temperature measurement device and the emission area measured with the optical microscope, a work function $\phi$ by the following formula (1) based on a Richardson Dash Man's formula, the work function $\phi$ being defined by the formula (1) using a cathode temperature T, a Boltzmann constant k, a Richardson constant A, a total emission I, and an area S of an electron emission surface;

determining whether or not the work function calculated of the cathode whose the total emission value has been measured with the ammeter and whose the temperature has been measured with the temperature measurement device, becomes within an acceptable value; and selecting the cathode determined, as a usable cathode for an electron beam lithography apparatus, in a case that the work function calculated of the cathode becomes within the acceptable value, wherein $$\phi=-kT\cdot In\{I/(SAT^2)\} \quad (1)$$

13. A cathode selection method comprising:

measuring, with an ammeter, a total emission emitted from a cathode having an electron emission surface which is a flat surface and a emission area which is limited;

calculating, based on the total emission value measured with the ammeter, a work function by a Richardson Dash Man's formula; and determining whether or not the cathode whose the total emission value has been measured with the ammeter has a work function equal to or less than an acceptable value.

14. The method according to claim 13, further comprising:

measuring, with a temperature measurement device, a temperature of the electron emission surface of the cathode when electrons are emitted from the cathode.

* * * * *